United States Patent [19]

Wasserstrom

[11] 4,267,947

[45] May 19, 1981

[54] BEVERAGE DISPENSER VALVE ARRANGEMENT

[75] Inventor: Henry Wasserstrom, Chicago, Ill.

[73] Assignee: Alco Foodservice Equipment Company, Miami, Fla.

[21] Appl. No.: 53,857

[22] Filed: Jul. 2, 1979

[51] Int. Cl.[3] ..... B65D 83/14

[52] U.S. Cl. ..... 222/399; 222/504; 251/130; 251/141

[58] Field of Search ..... 137/209; 251/130, 141, 251/175; 222/145, 394, 397, 399, 504, 505, 509, 51 B

[56] References Cited

U.S. PATENT DOCUMENTS

| | | | |
|---|---|---|---|
| 3,412,970 | 11/1968 | Robarge | 251/141 |
| 3,593,738 | 7/1971 | Baerfuss | 137/209 |
| 3,625,402 | 12/1971 | Kulis | 222/504 |

*Primary Examiner*—H. Grant Skaggs
*Attorney, Agent, or Firm*—Haight, Hofeldt, Davis & Jambor

[57] ABSTRACT

A valve arrangement for a liquid flavoring additive under pressure, particularly a non-homogeneous liquid such as high pulp orange juice concentrate, utilizes a fluid pressure to assist in terminating discharge of the liquid flavoring. The fluid pressure may be achieved by utilizing the same compressed air utilized to force the liquid flavoring through the valve structure. Suitable controls, such as a three-way valve, may be utilized to apply the pressurized air to a diaphragm on which a valve member is carried when the valve is to be closed to preclude discharge of the liquid flavoring additive, and to remove the pressure on the diaphragm, such as by venting it to air, when it is desired to permit discharge of the liquid flavoring.

6 Claims, 2 Drawing Figures

BEVERAGE DISPENSER VALVE ARRANGEMENT

BACKGROUND OF THE INVENTION

1. Field of the Invention

This invention relates generally to a liquid flavoring valve arrangement for beverage dispensers, and more specifically, this invention relates to a valve arrangement utilizing a pressurized fluid to assist in closing a valve controlling discharge of a non-homogeneous liquid flavoring additive.

2. Description of the Prior Art

Beverage dispensers of the post-mix type utilize controlled discharges of a liquid flavoring or concentrate and a diluent, such as carbonated water, to form the drink to be dispensed. Solenoid valves are normally utilized to determine the amounts of concentrate and carbonated water that are introduced into a mixing chamber to produce the drink for dispensing. A conventional solenoid valve of this type utilizes a valve member biased toward engagement with a valve seat to close the valve. Actuation of the solenoid causes the valve member to move against the bias force to open the valve for a predetermined time.

The flavoring concentrate utilized is normally pressurized, such as by insertion of a pressurized gas or air at the top of a container in which it is stored, in order to force the concentrate through the valve at a known rate of flow. To assist in opening the valve when it is desired to discharge concentrate, it is possible to take advantage of the pressure on the concentrate. Thus, the valve member will frequently be located upon a larger plate or diaphragm upon which the pressurized concentrate will bear even when the valve is closed. When the solenoid valve is actuated to open the valve, the pressurized concentrate will assist the solenoid drive in producing immediate separation of the valve member from the valve seat. This immediate opening of the valve is important to proper operation, since the amount of concentrate discharged is a time function. Any tendency of the valve member to stick on the valve seat would result in a weak or watery drink. Therefore, the positive opening aspect of utilizing the pressurized concentrate to assist the solenoid actuator is of value.

While this system works quite adequately for a homogeneous concentrate (e.g., various soft drink concentrates added to carbonated water), systems utilizing non-homogeneous liquid concentrates, such as pulpy orange juice concentrate, present some difficulties. As a result of the tendency of such non-homogeneous liquids to block or clog a valve and its related conduits, the conduits and the related valve passages must have a greater cross sectional area. This means that the area of the diaphragm on which the valve member is located is also greater. This greater diaphragm area means that the biasing force has greater resistance to closing after de-energization of the solenoid, due to the concentrate pressure being applied to the greater surface area. This can result in a slow closure of the valve, with the subsequent dispensing of a drink that is too strong. Also, as a result of the larger opposing force during closing, the valve member may not be tightly engaged with the valve seat, so that concentrate may drip from the dispenser. Accordingly, it would be desirable to have a valve arrangement that produces positive and accurate closing, as well as positive and accurate opening.

SUMMARY OF THE INVENTION

By means of the present invention, a valve arrangement is provided in which such a positive and accurate concentrate valve closure is achieved. Such a result is obtained by utilizing a fluid pressure on the side of the diaphragm opposite the pressurized concentrate during the time that the solenoid is de-energized and the valve is to be closed. This fluid pressure is removed when the solenoid is actuated to open the valve for discharge of the concentrate, so that positive and accurate opening of the valve is also realized. Preferably, the fluid pressure is obtained from the same source utilized to pressurize the concentrate.

In the valve arrangement of this invention, a conduit for the liquid flavoring or concentrate, such as an orange juice concentrate, extends to a location where the concentrate will be mixed with a diluent, such as water. A valve seat is provided at the end of the conduit away from the mixing location. A valve member is arranged to selectively engage the valve seat to prevent the discharge of concentrate through the conduit. This valve member is located or mounted on a diaphragm and extends from one side thereof. The other side of the diaphragm is secured to the armature of the solenoid. A suitable biasing force is provided, such as by a compression spring, to force the diaphragm to a position in which the valve member engages the valve seat.

The concentrate is forced through the valve and associated conduits under pressure. This pressure may be produced in any appropriate fashion, but normally it will be a compressed gas, such as air, inserted at the top of a container in which the concentrate is located. Since the diameter of the diaphragm is greater than the diameter of the valve member, the pressurized concentrate will bear against this diaphragm even when the valve is closed by having the valve member engage the valve seat. The bias force is sufficiently great to maintain the valve closed against this fluid pressure, except when the solenoid is actuated to pull the diaphragm against the bias force. The fluid pressure from the concentrate bearing against the diaphragm assists in achieving a positive and accurate opening of the valve.

When it is desired to close the valve, the solenoid (or actuating device) is de-energized to permit the bias force to urge the diaphragm against the fluid pressure produced by the concentrate. In order to assist the valve closing, a suitable control arrangement may be utilized to apply fluid pressure against the side of the diaphragm away from the concentrate. This pressure may be achieved in any appropriate fashion, such as by utilizing the same compressed air that pressurizes the concentrate. This pressure on the other side of the diaphragm offsets the pressure produced by the concentrate on the diaphragm, so that the bias force may achieve a rapid and positive closing of the valve.

When the valve is to be opened, the pressure applied to the other side of the diaphragm is removed by an appropriate pressure release arrangement, so as not to interfere with the positive and accurate opening of the valve. The control device and pressure release arrangement are preferably combined into a three-way valve.

It may be seen that this arrangement provides for the positive and accurate closing of a valve controlling discharge of a non-homogeneous concentrate, without interfering with the desired positive and accurate opening of that valve.

These and other objects, advantages and features of this invention will hereinafter appear, and for purposes of illustration, but not of limitation, an exemplary embodiment of the claimed invention is shown in the appended drawing.

DETAILED DESCRIPTION OF THE PREFERRED EMBODIMENT

Figure 1:
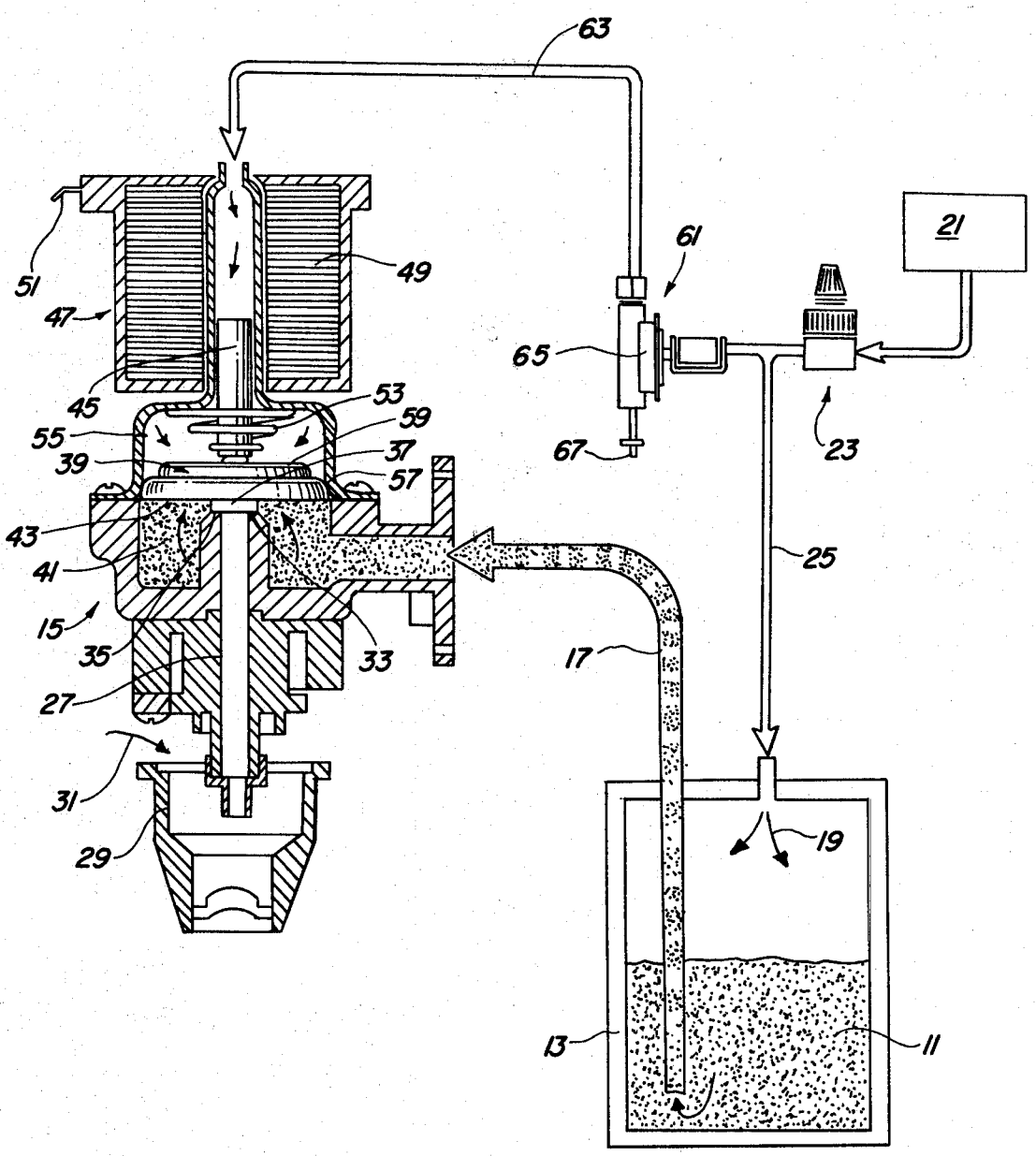
FIG. 1 is a schematic cross sectional view of a valve arrangement constructed in accordance with the present invention.
Figure 2:
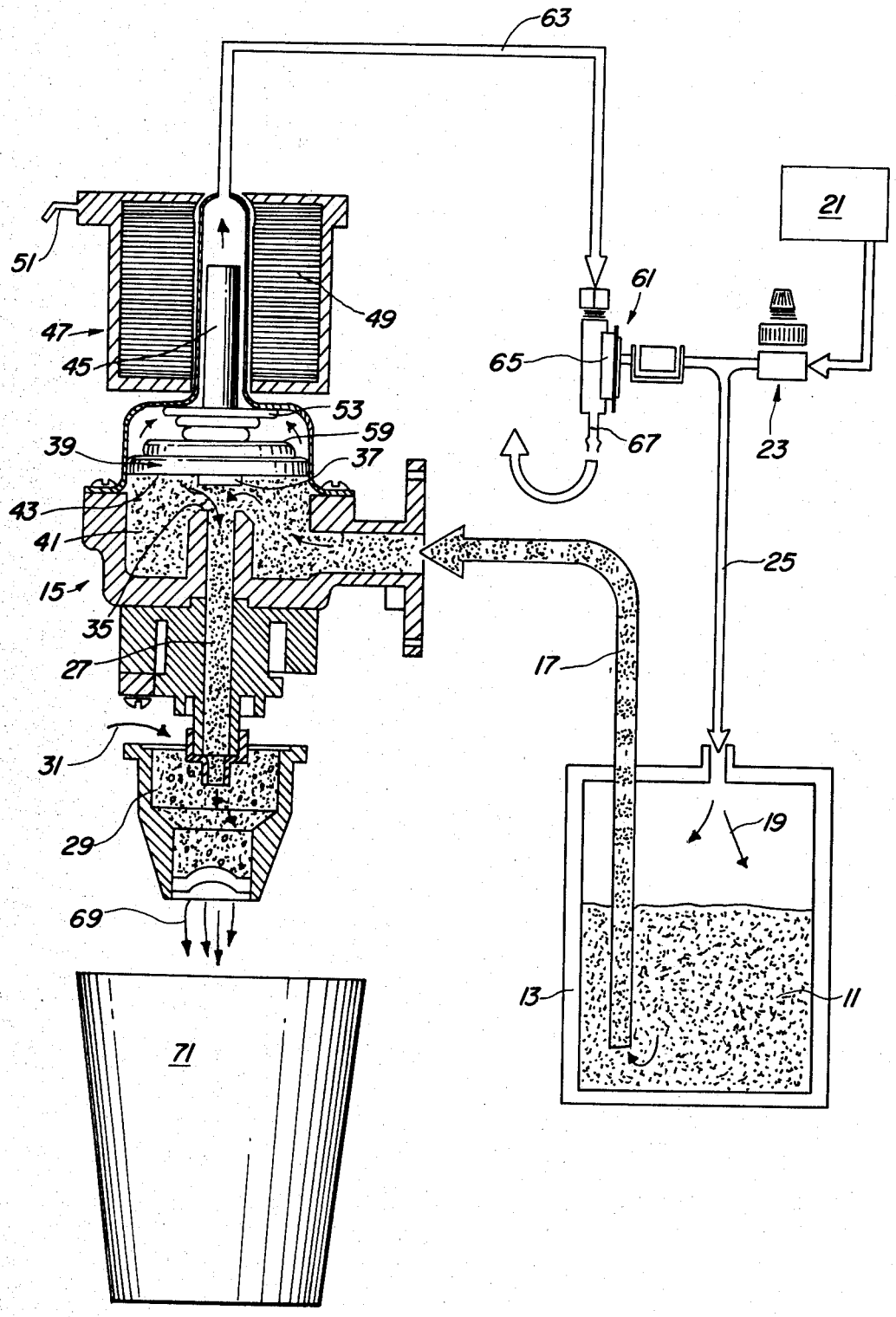
FIG. 2 is a schematic cross sectional view of the arrangement of FIG. 1 illustrated in a different operating condition.

In the preferred embodiment of the present invention, as disclosed in FIGS. 1 and 2, a liquid flavoring or concentrate 11 is located in a container or tank 13. While flavoring 11 could be any appropriate liquid flavoring, the present invention has particular applicability to the handling of non-homogeneous liquids, such as a pulpy orange juice concentrate. Therefore, for purposes of this discussion, the flavoring 11 will henceforth be referred to as an orange juice concentrate.

Tank 13 is any appropriate storage container. In order to prevent spoilage of the orange juice concentrate, tank 13 would be cooled by an appropriate refrigerating apparatus (not shown).

From tank 13, concentrate 11 is conveyed to a valve 15 through a line 17. In order to produce a desired flow of concentrate 11 through line 17 and valve 15, the orange juice concentrate 11 is put under pressure. This pressurization of the concentrate 11 may be achieved in any appropriate fashion, but in this preferred embodiment the pressurization is achieved by developing a fluid pressure at the top of container 13, as schematically represented by the arrows 19. The pressurizing fluid may be any suitable fluid inserted into container 13 under the desired pressure, but in this preferred embodiment a compressed gas, specifically compressed air is utilized. The compressed air is obtained from a compressor or storage tank represented generally at 21. The pressure of the compressed air is established by a suitable pressure regulator 23, and the compressed air having the established pressure is conveyed to container 13 through a line 25.

In the valve 15, a conduit 27 leads to a mixing location or a chamber 29. Concentrate 11 passing through conduit 27 is mixed with a diluent in the mixing chamber 29. Diluent being inserted into chamber 29 is represented by the arrow 31. This diluent may taken any appropriate form, such as carbonated water, but in this preferred embodiment where we were discussing an orange juice concentrate, the diluent represented by arrow 31 would be a potable water.

At end 33 of conduit 27, the end away from the mixing chamber 29, there is located a valve seat 35. A valve member 37 is arranged to engage valve seat 35, and when valve member 37 engages valve seat 35, as illustrated in FIG. 1, concentrate 11 cannot pass through the conduit 27.

Valve member 37 is located or mounted on a diaphragm 39 that has a diameter considerably larger than the diameter of the valve member 37. Thus, in the closed state of valve 15 shown in FIG. 1 the concentrate 11 in a chamber 41 bears against a side 43 of diaphragm 39. This produces a force of a magnitude determined by the area of surface 43 in excess of the area of valve member 37 and the pressure of the compressed air inserted into container 13.

Diaphragm 39 is secured to the armature 45 of a solenoid 47. Actuation of diaphragm 39 is produced by energization of a coil 49 through electrical leads schematically shown at 51.

Diaphragm 39 is continuously biased to the position of FIG. 1, in which the valve member 37 engages the valve seat 35. This biasing force is provided in any appropriate manner, such as by a compression spring 53.

As diaphragm 39 is moved back and forth in chamber 55, the outer perimeter 57 of diaphragm 39 maintains a sealing contact with the walls of the chamber 55. This sealing contact prevents escape of concentrate 11 from chamber 41 and hence provides for the maintenance of the force on surface 43 of diaphragm 39. Also, this sealing contact isolates side 43 of diaphragm 39 from the opposite side 59 thereof, in a fluid pressure sense.

During the time that solenoid 47 is de-energized, a suitable control is utilized to apply a fluid pressure to the surface 59 of diaphragm 39. In this preferred embodiment, the control is incorporated in a three-way valve 61 which conveys compressed air to side 59 of diaphragm 39 through a line 63. In this preferred embodiment, the compressed air conveyed through line 63 is from the source of compressed air 21 and the regulator 23 that determines the pressure applied to the concentrate 11. Thus, the pressure on side 59 of diaphragm 53 is equal to the pressure applied to side 43 of diaphragm 39.

When it is desired to dispense a drink, solenoid 47 is energized to draw armature 45 into the coil 49 and actuate diaphragm 39 against the bias force of spring 53. This state of operation is illustrated in FIG. 2. To achieve this operation, it is desired to remove the fluid pressure from side 59 of diaphragm 39. This objective is accomplished by a pressure release operation of the three-way valve 61. This pressure release function is realized by closing an inlet 65 in the three-way valve 61 to preclude the compressed air from passing through line 63. Simultaneously, a vent 67 is opened so that side 59 of diaphragm 39 is connected to atmosphere through line 63. Under these conditions, the fluid pressure of the concentrate in chamber 41 acting on side 43 of diaphragm 39, together with the solenoid force on the armature 45, acts to separate the valve member 37 from the valve seat 35.

With valve member 37 separated from valve seat 35, concentrate 11 passes through conduit 27 to be mixed with water 31 in mixing chamber 29. The resulting beverage, represented by the arrow 69, is then dispensed into a cup 71 for consumption by a customer.

After a predetermined time to permit passage of the desired amount of concentrate 11 to form the drink 69, solenoid 47 is de-energized to permit bias spring 53 to drive valve member 37 toward engagement with valve seat 35. Simultaneously, three-way valve 61 is activated to open the inlet 65 and close vent 67, as illustrated in FIG. 1. As a result of this action, the compressed air passes through line 63 to contact surface 59 of diaphragm 39 with the pressure established by regulator 23. The force generated by the pressure applied to surface 59 combines with the force provided by bias spring 53 to overcome the countering force produced by the pressure of concentrate 11 against surface 43 of diaphragm 39. The result is a positive and accurate closing of valve 15 upon de-energization of solenoid 47.

It should be understood that various modifications, changes and variations may be made in the arrangement, operation and details of construction of the elements disclosed herein without departing from the spirit and scope of this invention.

I claim:

1. A valve arrangement for a pressurized non-homogeneous flavoring additive in a beverage dispenser comprising:

a valve seat;

a valve member to engage said valve seat to prevent discharge of the non-homogeneous flavoring additive;

bias means urging said valve member into engagement with said valve seat;

actuating means to selectively provide a positive force to separate said valve member from said valve seat for a predetermined time to permit discharge of a predetermined amount of the non-homogeneous flavoring additive;

first pressure means responsive to the pressure of the non-homogeneous flavoring additive to assist said actuating means in separating said valve member from said valve seat against the force of said bias means;

second pressure means not utilizing the non-homogeneous flavoring additive to assist said bias means in moving said valve member to engagement with said valve seat against the force of said first pressure means; and pressure release means to deactivate said second pressure means upon energization of said actuating means.

2. A valve arrangement as claimed in claim 1 wherein said pressure means utilizes the same fluid pressure that is utilized to pressurize the non-homogeneous flavoring additive.

3. A valve arrangement as claimed in claim 2 wherein:

said valve member is mounted on a diaphragm;

said first pressure means is one side of said diaphragm against which the non-homogeneous flavoring additive bears; and said second pressure means is the other side of said diaphragm against which the fluid pressure is brought to bear.

4. A valve arrangement in a beverage dispenser for selectively passing a liquid flavoring, under pressure produced by compressed air, for mixing with a diluent to form a beverage to be dispensed and comprising:

a flavoring conduit to convey the liquid flavoring to a location for mixing with the diluent;

a valve seat at the end of said flavoring conduit away from the mixing location;

a valve member to engage said valve seat and prevent flow of liquid flavoring through said flavoring conduit;

a diaphragm having said valve member extending from one side thereof, the liquid flavoring contacting the side of said diaphragm from which said valve member extends;

bias means urging said diaphragm in a direction to bring said valve member into engagement with said valve seat;

actuating means to displace said diaphragm against the force of said bias means;

control means to apply the same compressed air that produces the pressure on the liquid flavoring against the side of said diaphragm away from said valve member to provide a fluid pressure of the same magnitude as the pressure on the liquid flavoring, when said diaphragm is to be positioned to cause said valve member to engage said valve seat against the pressure of the flavoring liquid; and pressure release means to remove said fluid pressure from said diaphragm upon energization of said actuating means to remove said valve member from said valve seat to permit passage of the flavoring liquid for dispensing the beverage, said control means and said pressure release means both being provided by a three-way valve that directs the compressed air to said diaphragm when said actuating means is de-energized and vents that side of said diaphragm to atmosphere when said actuating means is energized.

5. A valve arrangement as claimed in claim 4 wherein said actuating means is an electrically energized solenoid having its armature secured to said diaphragm.

6. A valve arrangement for controlling discharge of orange juice concentrate in an orange juice dispenser comprising:

a conduit to convey the orange juice concentrate to a mixing chamber to be mixed with water;

a valve seat formed at the top of said conduit away from said mixing chamber;

a valve member to engage said valve seat to prevent discharge of the orange juice concentrate through said conduit;

a diaphragm mounted for reciprocable motion in a first chamber, the wall of which is contacted with a fluid-tight seal by the outer periphery of said diaphragm, said valve member being mounted on and extending from the bottom side of said diaphragm;

a second chamber located below said first chamber, the upper portion of said conduit and its defining structure extending up into said second chamber and being surrounded by orange juice concentrate in said second chamber;

bias means urging said diaphragm downward to bring said valve member into engagement with said valve seat;

an electrically energized solenoid, the armature of said solenoid being secured to said diaphragm to raise said diaphragm against the force of said bias means upon energization of the solenoid;

a source of compressed air, said compressed air being utilized to pressurize the orange juice concentrate, the pressurized orange juice concentrate bearing against the bottom side of said diaphragm to assist the solenoid in raising said diaphragm against the force of said bias means; and a three-way valve to direct compressed air from said source to said first chamber to apply a fluid pressure to the top side of said diaphragm upon de-energization of said solenoid to assist said bias means in driving said valve member into engagement with said valve seat against the force produced by the pressurized orange juice concentrate bearing on the bottom of said diaphragm, said three-way valve also venting said first chamber to atmosphere upon energization of said solenoid.

* * * * *

UNITED STATES PATENT AND TRADEMARK OFFICE

CERTIFICATE OF CORRECTION

PATENT NO. : 4,267,947

DATED : May 19, 1981

INVENTOR(S) : Henry Wasserstrom

It is certified that error appears in the above-identified patent and that said Letters Patent are hereby corrected as shown below:

IN THE CLAIMS:

Column 5, line 38, after the word "said" add the word "second".

Signed and Sealed this

*Thirtieth* Day of *March 1982*

[SEAL]

*Attest:*

GERALD J. MOSSINGHOFF

*Attesting Officer*

*Commissioner of Patents and Trademarks*